US009541320B2

(12) United States Patent
Joung et al.

(10) Patent No.: US 9,541,320 B2
(45) Date of Patent: Jan. 10, 2017

(54) ICE MAKING METHOD

(75) Inventors: Jin-Kyu Joung, Seoul (KR); You-Shin Kim, Seoul (KR); Chul-Sun Dan, Seoul (KR)

(73) Assignee: Woongjin Coway Co., Ltd (KR)

( * ) Notice: Subject to any disclaimer, the term of this patent is extended or adjusted under 35 U.S.C. 154(b) by 201 days.

(21) Appl. No.: 13/702,904

(22) PCT Filed: Jun. 22, 2011

(86) PCT No.: PCT/KR2011/004565

§ 371 (c)(1),
(2), (4) Date: Dec. 7, 2012

(87) PCT Pub. No.: WO2011/162546

PCT Pub. Date: Dec. 29, 2011

(65) Prior Publication Data

US 2013/0074527 A1 Mar. 28, 2013

(30) Foreign Application Priority Data

Jun. 24, 2010 (KR) ..... 10-2010-0059893
Jun. 3, 2011 (KR) ..... 10-2011-0054068

(51) Int. Cl.
*F25C 1/20* (2006.01)
*F25C 1/08* (2006.01)
(Continued)

(52) U.S. Cl.
CPC . *F25C 1/08* (2013.01); *F25C 1/20* (2013.01); *F25C 5/08* (2013.01); *F25B 21/04* (2013.01);
(Continued)

(58) Field of Classification Search
CPC ..... F25C 1/18; F25C 1/10; F25C 1/20; F25C 1/08; F25C 5/08; F25C 2700/02; F25B 21/04
(Continued)

(56) References Cited

U.S. PATENT DOCUMENTS 2,572,508 A * 10/1951 Muffly ..... F25C 1/08 312/308
2,672,016 A * 3/1954 Muffly ..... F25C 1/08 62/137
(Continued)

FOREIGN PATENT DOCUMENTS

CN 100412474 8/2008
EP 0859205 8/1998
(Continued)

OTHER PUBLICATIONS

PCT/ISA/237 Written Opinion issued on PCT/KR2011/004565 (pp. 3).
(Continued)

*Primary Examiner* — Len Tran
*Assistant Examiner* — Kirstin Oswald
(74) *Attorney, Agent, or Firm* — The Farrell Law Firm, P.C.

(57) ABSTRACT

There is provided an ice making method capable of reducing the required number of gyrations of a gyration member used for making ice to have a high level of transparency and determining a point in time at which ice is to be released. The ice making method for making highly transparent ice by revolving a gyration member provided in a tray member in which water is put such that a plurality of dipping members, on which ice is generated or from which generated ice is released, are immersed, wherein a method for driving the gyration member in making ice to be supplied to a user and a method for driving the gyration member in making ice to be used for generating cold water are different in order to reduce the number of gyrations of the gyration member.

7 Claims, 8 Drawing Sheets

(51) Int. Cl.
*F25C 5/08* (2006.01)
*F25B 21/04* (2006.01)
*F25D 25/04* (2006.01)

(52) U.S. Cl.
CPC ..... *F25C 2600/04* (2013.01); *F25C 2700/02* (2013.01); *F25D 25/04* (2013.01)

(58) Field of Classification Search
USPC ..... 62/3.63, 356, 71, 68, 353
See application file for complete search history.

(56) References Cited

U.S. PATENT DOCUMENTS 3,180,110 A * 4/1965 Dunn ..... A23G 9/045 222/129.1
3,418,823 A * 12/1968 Salimbeni Vivai ..... F25C 1/08 62/138
3,791,166 A * 2/1974 Maleck ..... F25C 1/08 62/138
4,055,053 A * 10/1977 Elfving ..... F25B 21/02 62/3.63
4,321,802 A * 3/1982 Sakamoto ..... F25D 16/00 62/330
4,448,032 A * 5/1984 Hibino ..... C02F 1/22 414/269
4,538,428 A * 9/1985 Wilkerson ..... F25C 1/08 165/94
4,641,500 A 2/1987 Hosokawa et al.
5,205,129 A * 4/1993 Wright ..... A23G 9/163 62/136
5,345,783 A * 9/1994 Nishikawa ..... F25C 1/04 62/345
5,425,243 A * 6/1995 Sanuki ..... F25C 1/08 62/138
5,560,211 A * 10/1996 Parker ..... B67D 1/0869 62/137
5,617,728 A * 4/1997 Kim ..... F25C 1/04 62/353
5,873,441 A 2/1999 Tsujishita
5,970,725 A * 10/1999 Lee ..... F25C 1/04 62/137
6,148,620 A * 11/2000 Kumagai et al. ..... 62/72
7,032,391 B2 * 4/2006 Tremblay ..... F25C 1/04 62/351
2003/0046942 A1 * 3/2003 Shedivy ..... F25C 1/12 62/71
2004/0107721 A1 * 6/2004 Choi ..... F25C 1/08 62/340
2005/0155360 A1 * 7/2005 Yoshida ..... F25C 1/12 62/135
2007/0089451 A1 * 4/2007 Lee ..... F25C 1/12 62/352
2009/0223230 A1 * 9/2009 Kim ..... F25C 1/08 62/73
2010/0139295 A1 * 6/2010 Zuccolo ..... F25C 1/10 62/68
2012/0017627 A1 * 1/2012 Jeong ..... B67D 1/0861 62/344

FOREIGN PATENT DOCUMENTS

JP 09072639 3/1997
JP 10227548 8/1998
JP 2006-275510 10/2006
KR 100272894 3/1994
KR 1020070025750 3/2007
KR 100814687 3/2008
KR 1020080103860 11/2008
KR 1020090111716 10/2009

OTHER PUBLICATIONS

PCT/ISA/210 Search Report issued on PCT/KR2011/004565 (pp. 3).
European Search Report dated Aug. 19, 2016 issued in counterpart application No. 11798381.7-1605, 6 pages.

* cited by examiner (a) IN MAKING ICE TO BE SUPPLIED TO USER (b) IN MAKING ICE TO BE USED FOR GENERATING COLD WATER (d)

(e)

(d)

(e)

ICE MAKING METHOD

TECHNICAL FIELD

The present invention relates to an ice making method capable of reducing the required number of gyrations of a gyration member used for making ice having a high level of transparency and determining a point in time at which ice is to be released.

BACKGROUND ART

An ice maker IM shown in FIG. 1 is designed to make ice I, and such an ice maker IM is provided in a water purifier, a refrigerator, or the like.

As illustrated in FIG. 1, the ice maker IM includes an evaporator E in which cold refrigerant or a hot refrigerant flows in a refrigerating cycle (not shown). Also, a plurality of dipping members D are connected to the evaporator E, and a cold refrigerant or a hot refrigerant may flow in the dipping members D. A tray member T is also provided in the ice maker IM. Water is maintained in the tray member T, and the plurality of dipping members D are immersed in water in the tray member T. Accordingly, with the plurality of dipping members D immersed in the tray member T, when a cold refrigerant flows in the dipping members D, ice I is generated on the dipping members D. After ice I is generated on the dipping members D, when a hot refrigerant flows in the dipping members D, the ice I generated on the dipping members D is separated from the dipping members D. Namely, the ice I is released.

Recently, demand for highly transparent ice is increasing. To this end, in order to make highly transparent ice, an ice making method for making highly transparent ice by using an ultrasonic generator, and the like, is used.

In order to make highly transparent ice, a gyration member C provided to gyrate periodically in the tray member T as shown in FIG. 1 may be used. With water in the tray member T, when the gyration member C periodically gyrates, waves are generated in the water in the tray member T, and accordingly, a bubble layer cannot be grown in ice I when the ice I is generated on the dipping members D. Thus, highly transparent ice I can be generated on the dipping members D.

Besides the generation of the highly transparent ice I, the gyration member C may also be used to detect whether or not the formation of ice I generated on the dipping members D has reached an intended level along with a sensor S in order to determine a point in time at which the ice I is to be released.

Meanwhile, the ice maker IM may make ice I for generating cold water, as well as the ice I to be supplied to a user. Namely, the ice maker IM may make ice I to be supplied to a cold water tank (not shown) so as to cool water stored in the cold water tank and make or generate cold water.

In the related art ice making method, the ice I for generating cold water is also made to have a high level of transparency, like the ice I to be supplied to the user. This causes a problem in which the number of gyrations of the gyration member C is accordingly increased. Besides, as mentioned above, the gyration member C is required to gyrate periodically to detect whether or not the formation of ice has reached the intended level in order to determine a point in time at which the ice I is to be released. As a result, the number of gyrations of the gyration member C increases significantly.

When the number of gyrations of the gyration member C increases, a large load may be applied to the gyration member C or to a magnetic force generation member Me such as an electromagnet, or the like, used to drive the gyration member C, or the sensor S used to detect whether or not the formation of ice has reached the intended level in order to determine a point in time at which the ice I is to be released. Then, the durability of the configuration of the gyration member C, the sensor S, or the like, deteriorates and cannot be used for a long period of time.

DISCLOSURE OF INVENTION

Technical Problem

The present disclosure has been made upon recognizing at least one of the requests made or problems caused in the related art ice making method as mentioned above.

An aspect of the present invention provides an ice making method capable of reducing the required number of gyrations of a gyration member used to make highly transparent ice and determine a point in time at which ice is to be released.

Another aspect of the present invention provides an ice making method capable of reducing a load applied to a gyration member or a magnetic force generation member such as an electromagnet, or the like, used to drive the gyration member, or a sensor used to determine a point in time at which ice is to be released.

Another aspect of the present invention provides an ice making method capable of allowing a gyration member or a magnetic force generation member such as an electromagnet, or the like, or a sensor, or the like, to be used for a long period of time.

Solution to Problem

An ice making method in relation to an embodiment for accomplishing at least one of the foregoing objects may have the following characteristics.

The present disclosure is based on the use of different methods for driving a gyration member in making ice to be supplied to a user and in making ice for generating cold water in order to reduce the number of gyrations of the gyration member used to make highly transparent ice or detect whether or not the formation of ice has reached an intended level to determine a point in time at which ice is to be released.

According to an aspect of the present invention, there is provided an ice making method for making highly transparent ice by revolving a gyration member provided in a tray member in which water is put such that a plurality of dipping members, on which ice is generated or from which generated ice is released, are immersed, wherein a method for driving the gyration member in making ice to be supplied to a user and a method for driving the gyration member in making ice to be used for generating cold water are different, in order to reduce the number of gyrations of the gyration member.

Here, a driving duration of the gyration member in making ice to be supplied to the user and that of the gyration member in making ice used to generate cold water may be different.

The gyration member may be driven in making ice to be supplied to the user, and may not be driven in making ice to be used for generating cold water.

The gyration member may detect whether or not the formation of ice has reached an intended level in association with a sensor in order to determine a point in time at which the ice is to be released.

In making ice to be supplied to the user, the gyration member may be driven to make ice and determine a point in time at which ice is to be released, and in making ice to be used for generating cold water, the gyration member may be driven only to determine a point in time at which ice is to be released.

In making ice to be supplied to the user, the gyration member may be driven during a basic ice making time (or a basic ice making duration) in which ice of a certain size is generated on the dipping members and during an ice size detection time (or an ice size detection duration) in which it is determined whether or not the formation of ice has reached an intended level in order to determine a point in time at which ice is to be released, and in making ice to be used for generating cold water, the gyration member may be driven only during the ice size detection time.

The basic ice making time may be half to two-thirds of an ice making time (or an ice making duration) obtained by adding the basic ice making time and the ice size detection time, and the ice size detection time may be one-third to half of the ice making time.

A refrigerant may flow in the plurality of dipping members.

The plurality of dipping members may be connected to a thermoelectric module.

The gyration member may periodically gyrate.

The gyration member may be associated with a sensor to detect ice of various sizes.

In this case, a gyration period or a gyration angle of the gyration member varies according to the size of ice, and the sensor may measure the gyration period or the gyration angle of the gyration member.

Advantageous Effects of Invention

According to exemplary embodiments of the invention, the number of gyrations of the gyration member used to make highly transparent ice or to determine a point in time at which ice is to be released can be reduced.

Also, the load applied to the gyration member or the magnetic force generation member such as an electromagnet, or the like, used for driving the gyration member, or the sensor, or the like, used to determine a point in time at which ice is to be released can be reduced.

In addition, the gyration member or the magnetic force generation member such as an electromagnet, or the sensor can be used for a long period of time.

MODE FOR THE INVENTION

Figure 1:
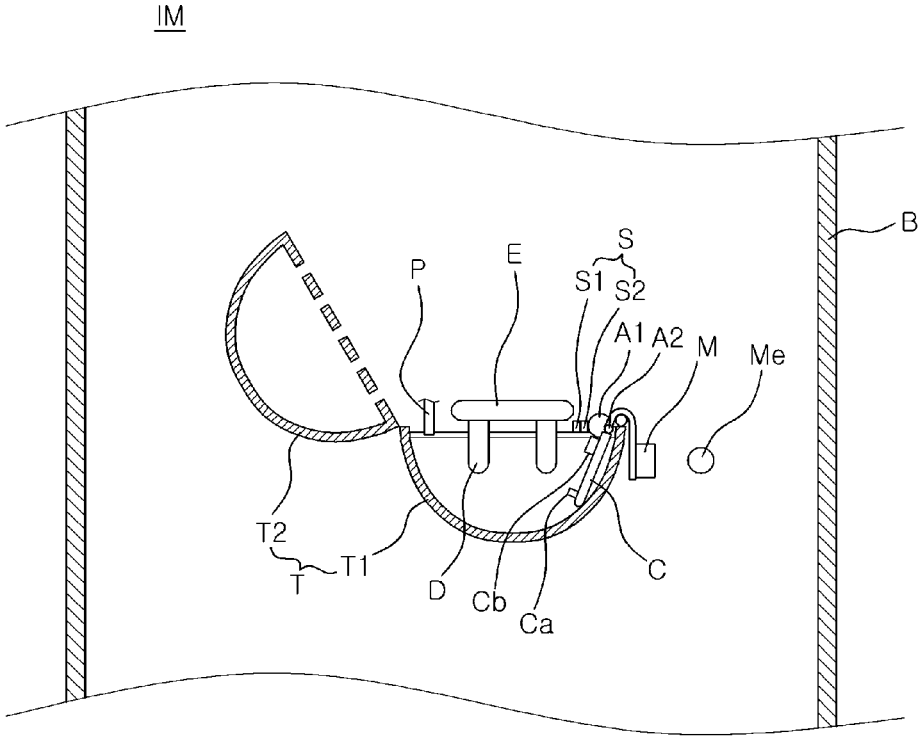
FIG. 1 shows an example of an ice maker to which an example of an ice making method according to an embodiment of the present invention may be applicable.

An ice making method according to an embodiment of the present invention will be described in detail hereinafter to help in an understanding of the characteristics of the present invention.

Exemplary embodiments of the present invention will now be described in detail with reference to the accompanying drawings. The invention may however be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Embodiments of the present invention are based on making a driving method of a gyration member in making ice to be supplied to a user and a driving method of the gyration member in making ice to be used for generating cold water different from one another in order to reduce the number of gyrations of the gyration member used to make highly transparent ice and detect whether or not the formation of ice has reached an intended level in order to determine a point in time at which ice is to be released.

Figure 8:
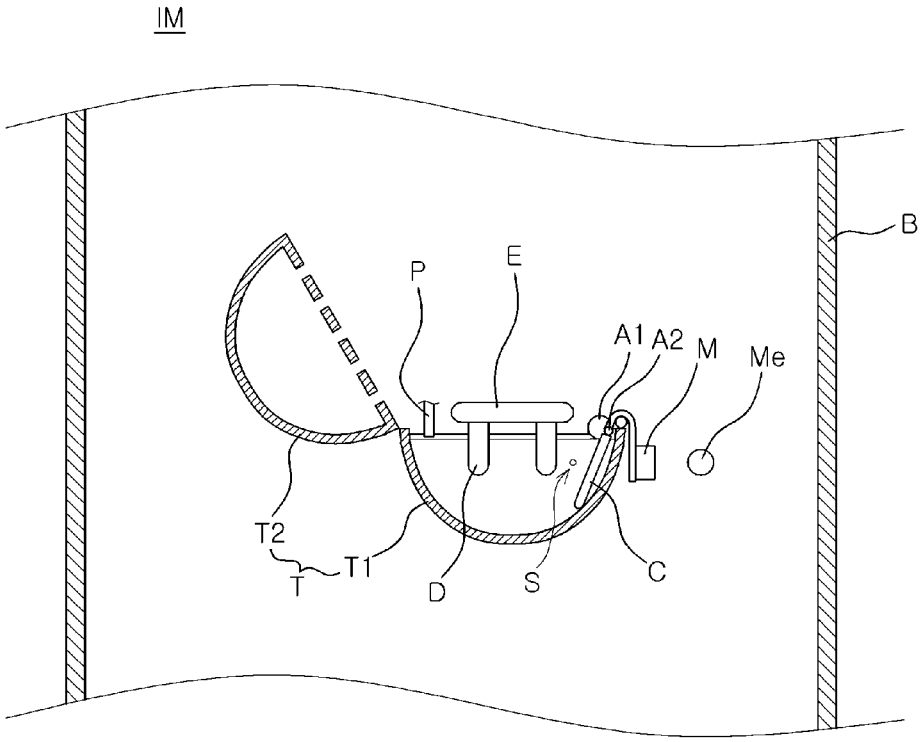
FIG. 8 shows another example of an ice maker to which an example of an ice making method according to an embodiment of the present invention may be applicable.

FIGS. 1 and 8 show two different examples of ice maker IM to which an ice making method according to an embodiment of the present invention can be applicable. The ice maker IM to which the ice making method according to an embodiment of the present invention is applicable is not limited to the illustrated examples and any ice maker IM may be used so long as it uses a gyration member C in order to make highly transparent ice I or detect whether or not the formation of ice has reached the intended level.

As shown in FIGS. 1 and 8, the ice maker IM to which the ice making method according to an embodiment of the present invention can be applicable may be provided to a main body B. The ice maker IM may include an evaporator E included in a refrigerating cycle (not shown). A cold refrigerant or a hot refrigerant may flow in the evaporator E. Also, as illustrated, a plurality of dipping members D may be connected to the evaporator E. Accordingly, the cold refrigerant or the hot refrigerant may also flow in the plurality of dipping members D.

In addition, a thermoelectric module (not shown) may be provided in the ice maker IM. The plurality of dipping members D may be connected to thermoelectric module. Accordingly, when the thermoelectric module is driven, the plurality of dipping members D may be cooled, and when the thermoelectric module is driven in reverse, the plurality of dipping members D may be heated.

As shown in FIGS. 1 and 8, a tray member T, into which water is inserted and which allows the plurality of dipping members D are immersed therein, may be rotatably provided in the ice maker IM. The tray member T may include a main tray member T1, in which water is provided to allow the dipping members D to be immersed therein, provided in the main body B such that it is rotatable about a rotational shaft A1 by being centered thereupon, and an auxiliary tray member T2 connected to the main tray member T1. However, the tray member T is not limited to the illustrated tray member, and any tray member may be used so long as it can maintain water, in which the plurality of dipping members D are immersed, therein. Meanwhile, water may be supplied to the tray member T, specifically, to the main tray member T1, through a water supply pipe P connected to a water purification tank (not shown), a cold water tank (not shown), or the like.

In the embodiments illustrated in FIGS. 1 and 8, the gyration member C is provided to gyrate about a rotational shaft A2 by being centered thereupon in the tray member T, specifically, in the main tray member T1. The gyration member C may periodically gyrate. However, the gyration member C may also aperiodically gyrate.

To this end, as shown in FIGS. 1 and 8, a magnetic substance M such as a permanent magnet, or the like, may be provided on the gyration member C. A magnetic force generation member Me, such as an electromagnet, or the like, may be provided in the main body B. Accordingly, when a magnetic force having a direction the same as or opposite to that generated by the magnetic substance M is generated from the magnetic force generation member Me periodically or aperiodically, the gyration member C can periodically or aperiodically gyrate about the rotational shaft A2 by being centered thereupon within the tray member T, namely, within the main tray member T1 in the embodiments illustrated in FIGS. 1 to 8. Accordingly, waves may be generated in the water within the tray member T, namely, within the main tray member T1 in the embodiments illustrated in FIGS. 1 to 8. Owing to the waves generated thusly, a bubble layer can be prevented from being grown in ice I when the ice I is generated while a cold refrigerant flows in the dipping members D or the dipping members D are cooled according to driving of the thermoelectric module. Accordingly, highly transparent ice I can be formed on the dipping members D. However, the configuration of the periodical or aperiodical gyration of the gyration member C is not limited to the magnetic substance M and the magnetic force generation member Me as shown in FIGS. 1 to 8, and any configuration including a configuration in which the gyration member C periodically or aperiodically gyrates in the tray member T, specifically, in the main tray member T1 illustrated in FIGS. 1 to 8, a configuration in which the gyration member C periodically or aperiodically gyrates by a driving motor (not shown), or the like, can be used.

Meanwhile, in order to determine a point in time at which the ice I is to be released, as shown in FIGS. 1 to 8, a sensor S is provided in the main body B. The sensor S, in association with the gyration member C, may be able to detect whether or not the formation of ice has reached the intended level.

To this end, as shown in FIG. 1, the sensor S may include an electromagnetic wave transmission member S1 for transmitting electromagnetic waves and an electromagnetic wave reception member S2 for receiving electromagnetic waves. The gyration member C may include a contact member Ca and an electromagnetic wave reflective member Cb.

With such a configuration, when the formation of ice I has not reached the intended level, according to the gyration of the gyration member C, electromagnetic waves transmitted from the electromagnetic wave transmission member S1 are reflected by the electromagnetic wave reflective member Cb of the gyration member C and received by the electromagnetic wave reception member S2. The transmission of the electromagnetic waves from the electromagnetic wave transmission member S1, the reflection of electromagnetic waves by the electromagnetic wave reflective member Cb, and the reception of the electromagnetic waves by the electromagnetic wave reception member S2 may be performed periodically or aperiodically, according to a periodical or aperiodical gyration of the gyration member C.

Meanwhile, when the formation of ice has reached the intended level, the contact member Ca of the gyration member C is brought into contact with the ice I according to the gyration of the gyration member C. Then, the transmission of the electromagnetic waves from the electromagnetic wave transmission member S1, the reflection of electromagnetic waves by the electromagnetic wave reflective member Cb, and the reception of the electromagnetic waves by the electromagnetic wave reception member S2 as mentioned above are not performed. Thus, it can be detected that the formation of ice has reached an intended level, and accordingly, a point in time at which the ice I is to be released can be determined.

Also, as shown in FIG. 8, the gyration member C may be associated with the sensor S to detect the ice I having various sizes. Namely, even when the size of requested ice I varies, it can be detected that the formation of ice has reached an intended level by the gyration member C and the sensor S, and accordingly, a point in time at which the ice I is to be released can be determined.

To this end, as shown in FIG. 8, a gyration period and a gyration angle of the gyration member C may vary according to the size of ice I. Namely, magnetic force in one direction may be generated from the magnetic force generation member Meor a driving motor (not shown) may be rotated in one direction. Accordingly, the gyration member C gyrates in one direction, i.e., the direction to the dipping members D. When the sensor (not shown) provided at the rotational shaft A2 of the gyration member C senses that the gyration member C is in contact with the dipping members D or the ice I generated on the dipping members D, magnetic force in a different direction may be generated from the magnetic force generation member Me or the driving motor rotates in the different direction. Accordingly, the gyration member C gyrates in the different direction, namely, in the direction to the main tray member T1. Also, when the sensor senses that the gyration member C gyrates in the different direction so as to be brought into contact with the main tray member T1, magnetic force is generated from the magnetic force generation member Me in one direction or the driving motor rotates in one direction. Accordingly, the gyration period or gyration angle of the gyration member C may vary according to the size of the ice I.

As shown in FIG. 8, when the gyration member C periodically gyrates, the sensor S may measure the gyration period of the gyration member C. Also, when the gyration member C periodically or aperiodically gyrates, the sensor S may measure the gyration angle of the gyration member C. To this end, the sensor illustrated in FIG. 8 may include an electromagnetic wave transmission member and an electromagnetic wave reception member. Namely, the sensor S provided on one surface of the main tray member T1 may be the electromagnetic wave transmission member, and an electromagnetic wave reception member (not shown) may be formed on the other surface of the main tray member (which is not shown) facing one surface of the main tray member T1 having the electromagnetic wave transmission member. When the gyration member C gyrates in such a manner as described above, the gyration member C cuts off an electromagnetic wave path between the electromagnetic wave transmission member and the electromagnetic wave reception member included in the sensor S. Thus, the gyration period of the gyration member C can be measured, and the gyration angle according to the gyration period can be calculated.

Meanwhile, in the configuration in which the gyration member C gyrates by a driving motor, a gyration angle of the gyration member C can be measured by a sensor (not shown) installed in the driving motor and a corresponding gyration period can be calculated.

Accordingly, the gyration period or gyration angle of the gyration member C can be measured by the sensor S, and the size of ice I can be detected. Accordingly, when the gyration period or gyration angle measured by the sensor S are gyration period or gyration angle corresponding to the desired ice I, it may be determined that the formation of ice has reached the intended level and a point in time at which the ice I is to be released can be determined.

However, the configuration for determining the point in time at which ice I is to be released is not limited to the configuration of the electromagnetic wave transmission member S1, the electromagnetic wave reception member S2, the contact member Ca, the electromagnetic wave reflective member Cb, and the like, as described above with reference to in FIGS. 1 and 8, and any configuration, for example a configuration in which ice I is released after the lapse of a certain amount of time, may be implemented so long as it is sensed that the formation of ice has reached the intended level so the point in time at which ice I is to be released can be determined.

As in the embodiment illustrated in FIGS. 2 to 7, in the ice making method according to an embodiment of the present invention, different driving methods of the gyration member C may be provided. Namely, the gyration member C may be driven differently in making ice I to be supplied to the user, namely, in making highly transparent ice I, and in making ice I not required to be highly transparent, namely, in making ice I to be used for generating cold water, to thus reduce the number of gyrations of the gyration member C of the ice maker IM.

To this end, a driving time (or driving duration) of the gyration member C may be different in making ice to be supplied to the user to that in making ice I to be used for generating cold water. The number of gyrations of the gyration member C or a gyration interval of the gyration member C may also be different in making ice to be supplied to the user and in making ice I to be used for generating cold water. For example, in making ice I to be supplied to the user, the number of gyrations of the gyration member C may be increased or the gyration interval of the gyration member C may be reduced, and in making ice I to be used for generating cold water, the number of gyrations of the gyration member C may be decreased or the gyration interval of the gyration member C may be increased.

When the driving time is adjusted to be different in making ice to be supplied to the user and in making ice I to be used for generating cold water, the gyration member C is not required to continually gyrate periodically or aperiodically in making ice to be supplied to the user and in making ice I to be used for generating cold water, so the number of gyrations can be reduced. Thus, a load applied to the gyration member C or the magnetic force generation member Me such as an electromagnet, or the like, used for driving the gyration member C or the sensor S used to detect whether or not the formation of ice has reached the intended level in order to determine a point in time at which the ice is to be released can be reduced. Thus, the durability of the configuration can be improved, so those elements can be used for a long period of time.

To this end, the gyration member C may be driven in making ice to be supplied to the user, while the gyration member C may not be driven in making ice I to be used for generating cold water. Thus, in this case, the determining of the point in time at which ice I is to be released is not made by the gyration member C but may be made through a different method. Namely, ice I is released when a certain time elapses, or an electromagnetic wave is interrupted when the formation of ice has reached an intended level. Thus, since the gyration member C is driven to gyrate only in making ice I to be supplied to the user, the number of gyrations of the gyration member C can be reduced.

Meanwhile, in a case in which the gyration member C detects whether or not the formation of ice has reached the intended level in association with the sensor S in order to determine a point in time at which ice I is to be released, as shown in FIGS. 2 to 7, in making ice to be supplied to the user, namely, in making ice I required to be highly transparent, the gyration member C may be driven to make ice I and determine a point in time at which ice I is to be released. While, in making ice I to be used for generating cold water, namely, in making ice I not required to be highly transparent, the gyration member C may be driven only in order to determine a point in time at which ice I is to be released.

Figure 3:
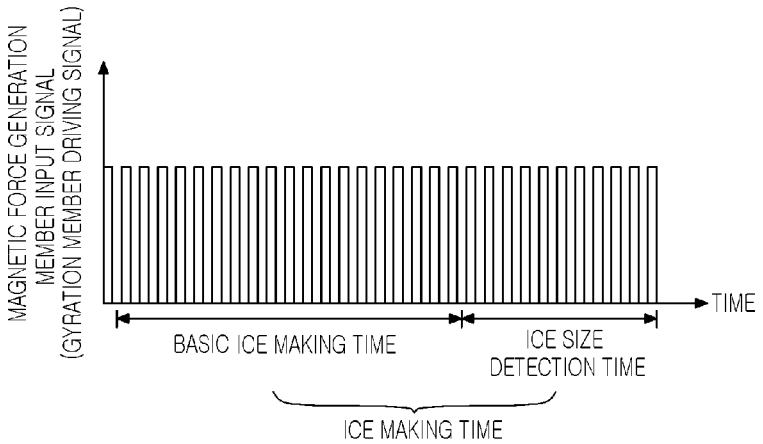
FIG. 3 is graphs showing a driving duration of a gyration member in making ice to be supplied to a user and a driving duration of the gyration member in making ice to be used for generating cold water according to an example of an ice making method according to an embodiment of the present invention.
Figure 3:
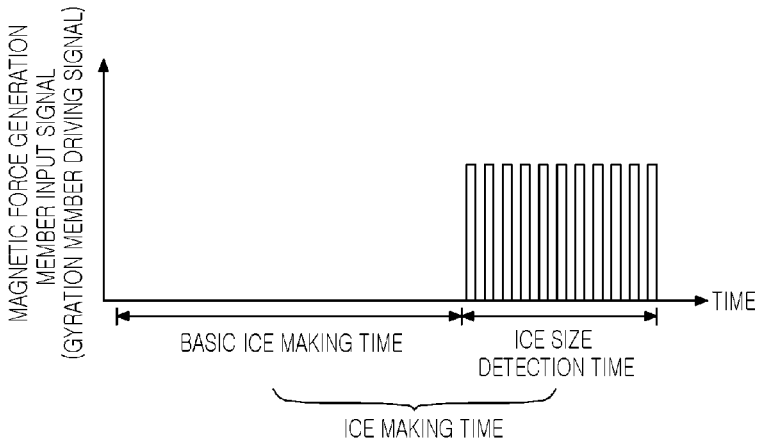

To this end, as shown in FIG. 3, in making ice I to be supplied to the user, the gyration member C may be driven during a basic ice making time in which ice I having a certain size is generated on the dipping members D and during an ice size detection time in which whether or not a formation of ice has reached an intended level in order to determine a point in time at which ice I is to be released. Meanwhile, in making ice I to be used for generating cold water, the gyration member C may be driven only during the ice size detection time. Namely, in making ice I to be supplied to the user, a signal for driving the gyration member C is transmitted to the magnetic force generation member Me during the ice making time obtained by adding the basic ice making time and the ice size detection time, and in making ice I to be used for generating cold water, a signal may be transmitted to the magnetic force generation member Me only during the ice size detection time in order to determine a point in time at which ice is to be released.

Figure 2:
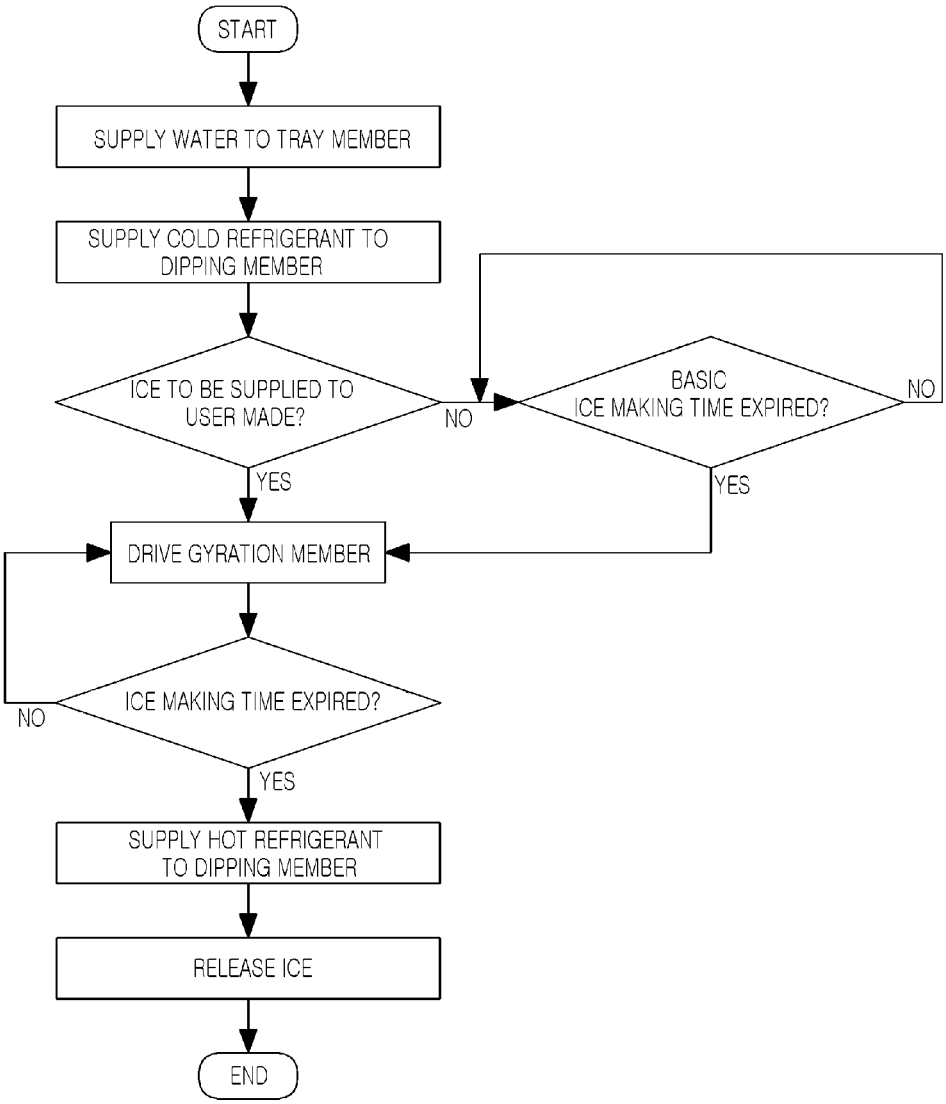
FIG. 2 is a flow chart illustrating the process of an ice making method according to an embodiment of the present invention.

Also, in order to implement this, as shown in FIG. 2, in making ice I to be supplied to the user, a cold refrigerant may be first supplied to the dipping members D and the foregoing signal may be then transmitted to the magnetic force generation member Me to drive the gyration member C. Further, in making ice I to be used for generating cold water, as shown in FIG. 2, when the basic ice making time arrives, the foregoing signal may be transmitted to the magnetic force generation member Me to drive the gyration member C.

After the gyration member C is driven, when ice making time expires, namely, when the point in time at which ice is to be released arrives as the sensor S senses that the formation of ice has reached the intended level, a hot refrigerant is supplied to the dipping members D to release the ice I. Thereafter, in the case of ice I to be supplied to the user, the released ice may be transferred to an ice repository (not shown) so as to be stored, and in case of ice I to be used for generating cold water, released ice I may be transferred to a cold water tank (not shown) to cool water stored in the cold water tank.

Meanwhile, the basic ice making time may be ½ (half) to ⅔ (two-thirds) of the ice making time. Correspondingly, the ice size detection time may be one-third to half of the ice making time. If the basic ice making time is less than half of the ice making time, namely, if the ice size detection time exceeds half of the ice making time, the number of gyrations of the gyration member C required to make ice I for generating cold water is not greatly reduced, and is not sufficient to achieve the object of the present invention for reducing the required number of gyrations of the gyration member C. If the basic ice making time exceeds two-thirds of the ice making time, namely, if the ice size detection time is less than one-third of the ice making time, the sensor S may not appropriately sense whether or not formation of ice has reached an intended level to determine the point in time at which ice is to be released in making ice I to be used for generating cold water. Thus, preferably, the basic ice making time for reducing the required number of gyrations of the gyration member C and appropriately determining the point in time at which ice is to be released by the gyration member C is half to two-thirds of the ice making time, and a corresponding ice size detection time may be one-third to half of the ice making time.

Figure 4:
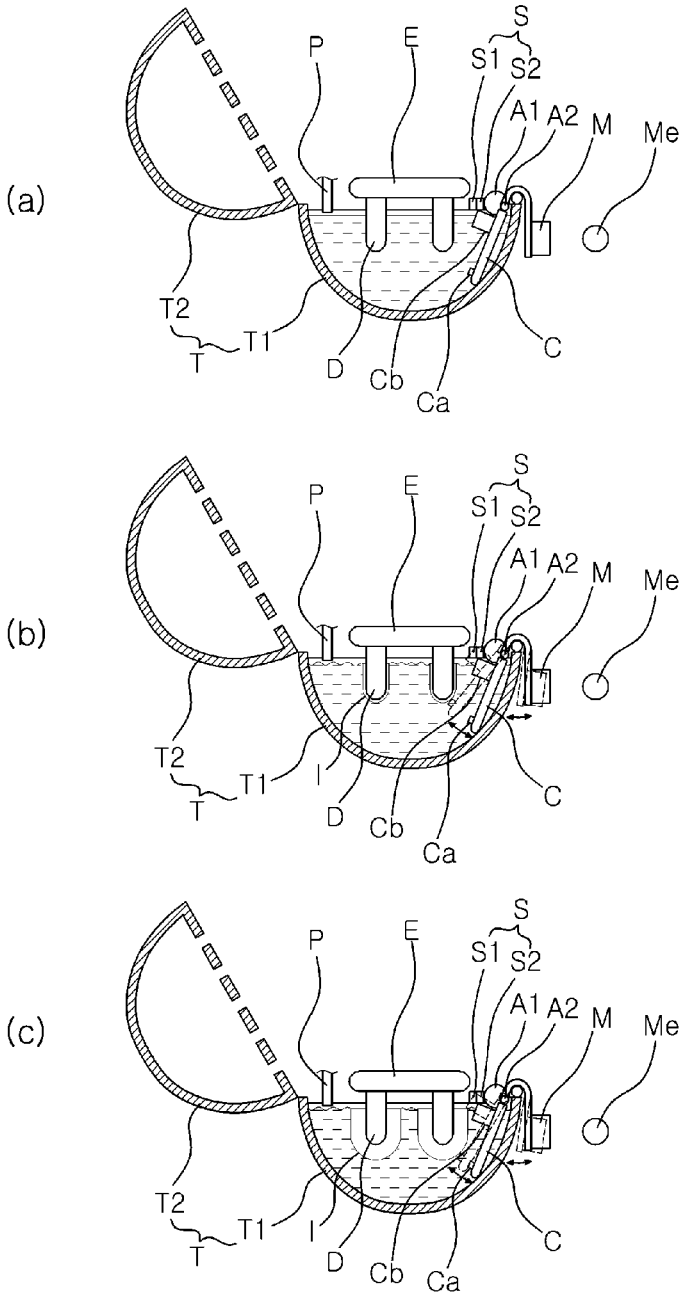
FIGS. 4 and 5 show how ice to be supplied to a user is made according to an example of an ice making method according to an embodiment of the present invention.

An ice making method according to an embodiment of the present invention will now be described by using the ice maker IM illustrated in FIG. 1 with reference to FIGS. 2 and 4 to 7. When ice making starts, the tray member T is positioned as shown in FIG. 4(*a*) and FIG. 6(*a*). Further, as shown in FIGS. 2, 4(*a*) and 6(*a*), water is supplied to the tray member T, namely, the main tray member T1 of the tray member T, through the water supply pipe P.

As shown in FIG. 2, the refrigerating cycle (not shown) is initiated so as to allow a cold refrigerant to flow in the evaporator E and also to flow in the dipping members D. Accordingly, ice I is generated on the dipping members D as shown in FIGS. 4(*b*) and 6(*b*).

Meanwhile, a controller (not shown) provided in the ice maker IM may measure the amount of ice I of the ice repository (not shown) in which ice I to be supplied to the user is kept in storage or the temperature of water stored in the cold water tank (not shown) to determine whether to make ice I to be supplied to the user or whether to make ice I to be used for generating cold water. For example, when it is determined that the ice repository is empty, the controller may make ice I to be supplied to the user, and when the temperature of the cold ice tank is higher than a requested temperature by a certain amount, the controller may make ice I to be used for generating cold water.

When ice I to be supplied to the user is made because the amount of ice I kept in storage in the ice repository is small as shown in FIG. 2, the gyration member C is driven as shown in FIG. 4(*b*). Accordingly, waves are generated in water stored in the main tray member T1. Thus, a bubble layer is not grown in ice I generated on the dipping members D, thus generating highly transparent ice I on the dipping members D.

Figure 6:
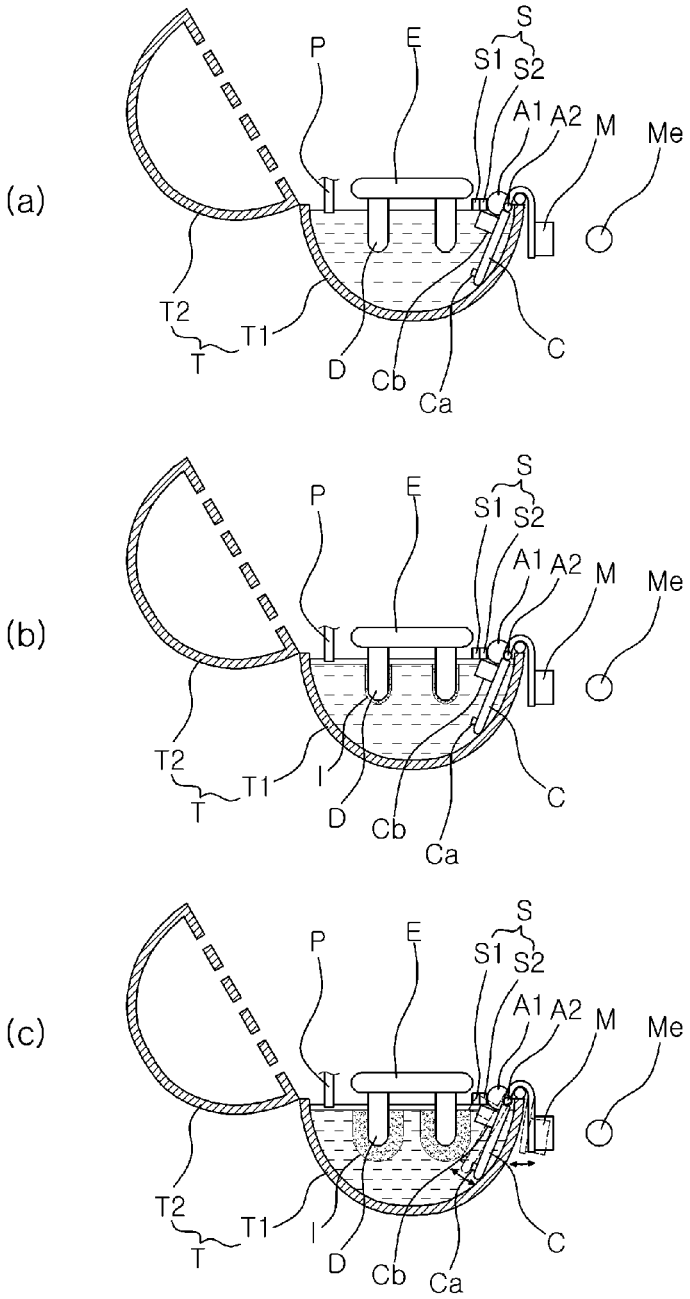
FIGS. 6 and 7 show how ice to be used for generating cold water is generated according to an example of an ice making method according to an embodiment of the present invention.

Meanwhile, when ice I to be supplied to the user is not made, namely, when ice I to be used for generating cold water because the temperature of the cold water tank is higher by a certain temperature level than a requested temperature, the gyration member C is not driven as shown in FIG. 6(*b*). Thus, in this case, waves are not generated in water stored in the main tray member T1, generating ice I which is not highly transparent, namely, opaque ice I, on the dipping members D. Thus, since the gyration member C does not periodically or aperiodically gyrate, the number of gyrations of the gyration member C can be reduced.

Figure 7:
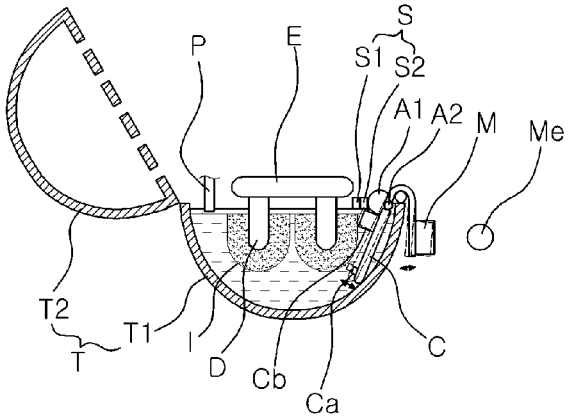
Figure 7:
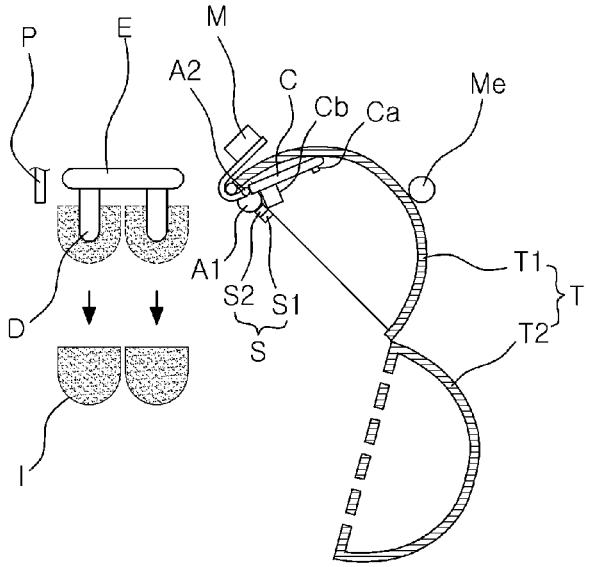

Meanwhile, in making ice I to be used for generating cold water as shown in FIGS. 6 and 7, when the basic ice making time for generating ice I having a certain size on the dipping members D expires as shown in FIG. 2, the gyration member C is driven in order to detect whether or not a formation of ice has reached an intended level in order to determine a point in time at which ice I is to be released as shown in FIG. 6(*c*).

Figure 5:
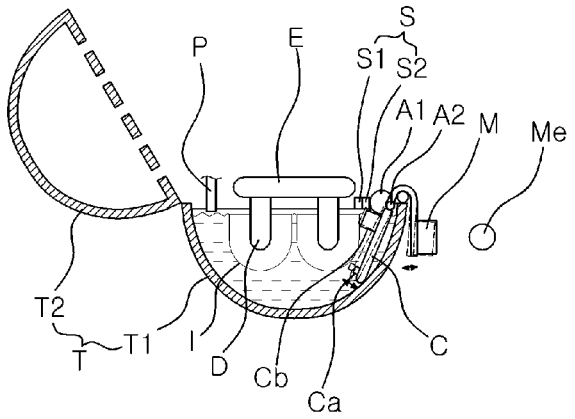
Figure 5:
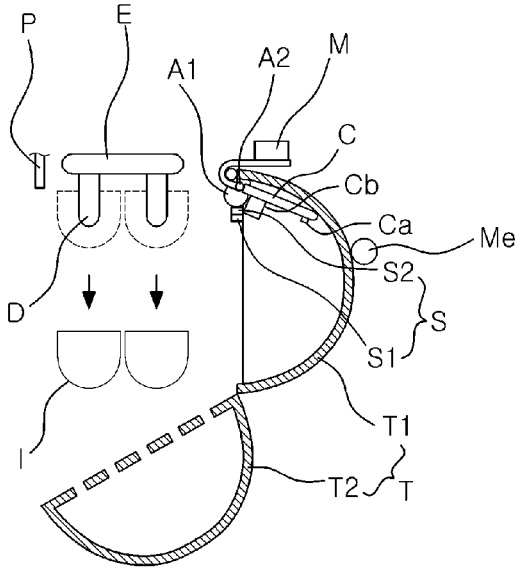

In this manner, ice I to be supplied to the user and ice I to be used for generating cold water are generated on the dipping members D, and as shown in FIGS. 5(*d*) and 7(*d*), when the sensor S senses that the formation of ice I generated on the dipping members D has reached the intended level, so the point in time at which ice is to be released is determined, namely, when the ice making time expires, a hot refrigerant is supplied to the evaporator E.

In this case, as shown in FIG. 5(*e*), the tray member T rotates to transmit ice I, which is to be supplied to the user, to the ice repository (not shown). Accordingly, the highly transparent ice I, which has been released from the dipping members D according to the supply of the hot refrigerant so as to be supplied to the user, is transmitted to the ice repository and supplied to the user.

Meanwhile, as shown in FIG. 7(*e*), the tray member T rotates to transmit ice I, which is to be used for generating cold water, to the cold water tank (not shown). Accordingly, ice I, which is not highly transparent, has been released from the dipping members D according to the supply of the hot refrigerant, and is to be used for generating cold water, is dropped into the cold water tank to cool water stored in the cold water tank.

As set forth above, according to exemplary embodiments of the invention, the number of gyrations of the gyration member used to make highly transparent ice or to determine a point in time at which ice is to be released can be reduced.

Also, the load applied to the gyration member or the magnetic force generation member such as an electromagnet, or the like, used for driving the gyration member, or the sensor, or the like, used to determine a point in time at which ice is to be released can be reduced.

In addition, the gyration member or the magnetic force generation member such as an electromagnet, or the sensor can be used for a long period of time.

While the present invention has been shown and described in connection with the exemplary embodiments, it will be apparent to those skilled in the art that modifications and variations can be made without departing from the spirit and scope of the invention as defined by the appended claims.

The invention claimed is:

1. An ice making method for making transparent ice by revolving a gyration member provided in a tray member in which water is put such that a plurality of dipping members, on which ice is generated or from which generated ice is released, are immersed, wherein a method for driving the gyration member in making ice to be supplied to a user and a method for driving the gyration member in making ice to be used for generating cold water are different in order to reduce the number of gyrations of the gyration member, wherein the gyration member detects whether or not the generated ice has reached a level in order to determine a point in time at which the ice is to be released, and wherein, in making ice to be supplied to the user, the gyration member is driven to both make ice and determine the point in time at which ice is to be released, and in making ice to be used for generating cold water, the gyration member is driven only to determine the point in time at which ice is to be released, and wherein, in making ice to be supplied to the user, the gyration member is driven during an ice formation time in which ice having a certain size is generated on the plurality of dipping members and during an ice size detection time in which it is determined whether or not the formation of ice has reached the level in order to determine the point in time at which ice is to be released after the ice formation time, and in making ice to be used for generating cold water, the gyration member is driven only during the ice size detection time after the ice formation time.

2. The method of claim 1, wherein the ice formation time is half to two-thirds of the ice making time, obtained by adding the ice formation time and the ice size detection time, and the ice size detection time is one-third to half of the ice making time.

3. The method of claim 1, wherein a refrigerant flows in the plurality of dipping members.

4. The method of claim 1, wherein the plurality of dipping members are connected to a thermoelectric module.

5. The method of claim 1, wherein the gyration member periodically gyrates.

6. The method of claim 1, wherein the gyration member is associated with a sensor to detect ice of various sizes.

7. The method of claim 6, wherein a gyration period or a gyration angle of the gyration member varies according to the certain size of the ice, and the sensor measures the gyration period or the gyration angle of the gyration member.

* * * * *